US005875913A

United States Patent [19]

Letica

[11] Patent Number: 5,875,913

[45] Date of Patent: Mar. 2, 1999

[54] TAMPER EVIDENT PAIL AND CLOSURE

[75] Inventor: Anton I. Letica, Rochester Hills, Mich.

[73] Assignee: Letica Corporation, Rochester, Mich.

[21] Appl. No.: 937,453

[22] Filed: Sep. 25, 1997

[51] Int. Cl.[6] ..... B65D 25/28; B65D 17/32

[52] U.S. Cl. ..... 220/269; 220/780; 220/756; 220/763; 220/771

[58] Field of Search ..... 220/265, 266, 220/268, 269, 270, 276, 751, 752, 756, 758, 759, 760, 762, 763, 764, 766, 769, 771, 773, 317, 318, 780, 793

[56] References Cited

U.S. PATENT DOCUMENTS

| | | | |
|---|---|---|---|
| 3,851,790 | 12/1974 | Kasper | 220/751 X |
| 4,024,976 | 5/1977 | Acton . | |
| 4,027,775 | 6/1977 | Mygatt, Jr. et al. . | |
| 4,190,175 | 2/1980 | Allen . | |
| 4,296,871 | 10/1981 | Andersson . | |
| 4,711,364 | 12/1987 | Letica . | |
| 4,998,622 | 3/1991 | Drack | 220/266 X |
| 5,027,969 | 7/1991 | Lesquir . | |
| 5,090,583 | 2/1992 | Hoffman et al. . | |
| 5,115,934 | 5/1992 | Nelson . | |
| 5,224,617 | 7/1993 | Gaudreault . | |
| 5,249,694 | 10/1993 | Nelson . | |
| 5,253,772 | 10/1993 | Earnest . | |
| 5,303,839 | 4/1994 | Blumenschein . | |
| 5,307,948 | 5/1994 | Blackburn et al. . | |
| 5,344,041 | 9/1994 | Luburic et al. | 220/760 |
| 5,437,386 | 8/1995 | Von Holdt | 220/268 X |
| 5,526,954 | 6/1996 | Georgiadis | 220/763 X |
| 5,704,507 | 1/1998 | Krall et al. | 220/771 X |

*Primary Examiner*—Stephen K. Cronin
*Assistant Examiner*—Nathan Newhouse
*Attorney, Agent, or Firm*—Young & Basile, P.C.

[57] ABSTRACT

A molded plastic pail and a snap-on closure having a flared skirt the bottom of which is manually engaged for removal purposes. A peripheral ring structure integral with the pail sidewall immediately underlies the skirt of the closure when in the sealing relationship with the pail thereby to block access to the skirt. However, a section of the rib structure essentially midway between the bail ears includes a break away panel connected to the rib structure by frangible webs and a living hinge so that it may be pivoted outwardly and downwardly away from the pail wall to afford access to a sufficient portion of the closure skirt to permit removal. The break away section thereafter serves as an integral handle to facilitate pouring from the container.

6 Claims, 3 Drawing Sheets

FIG-1
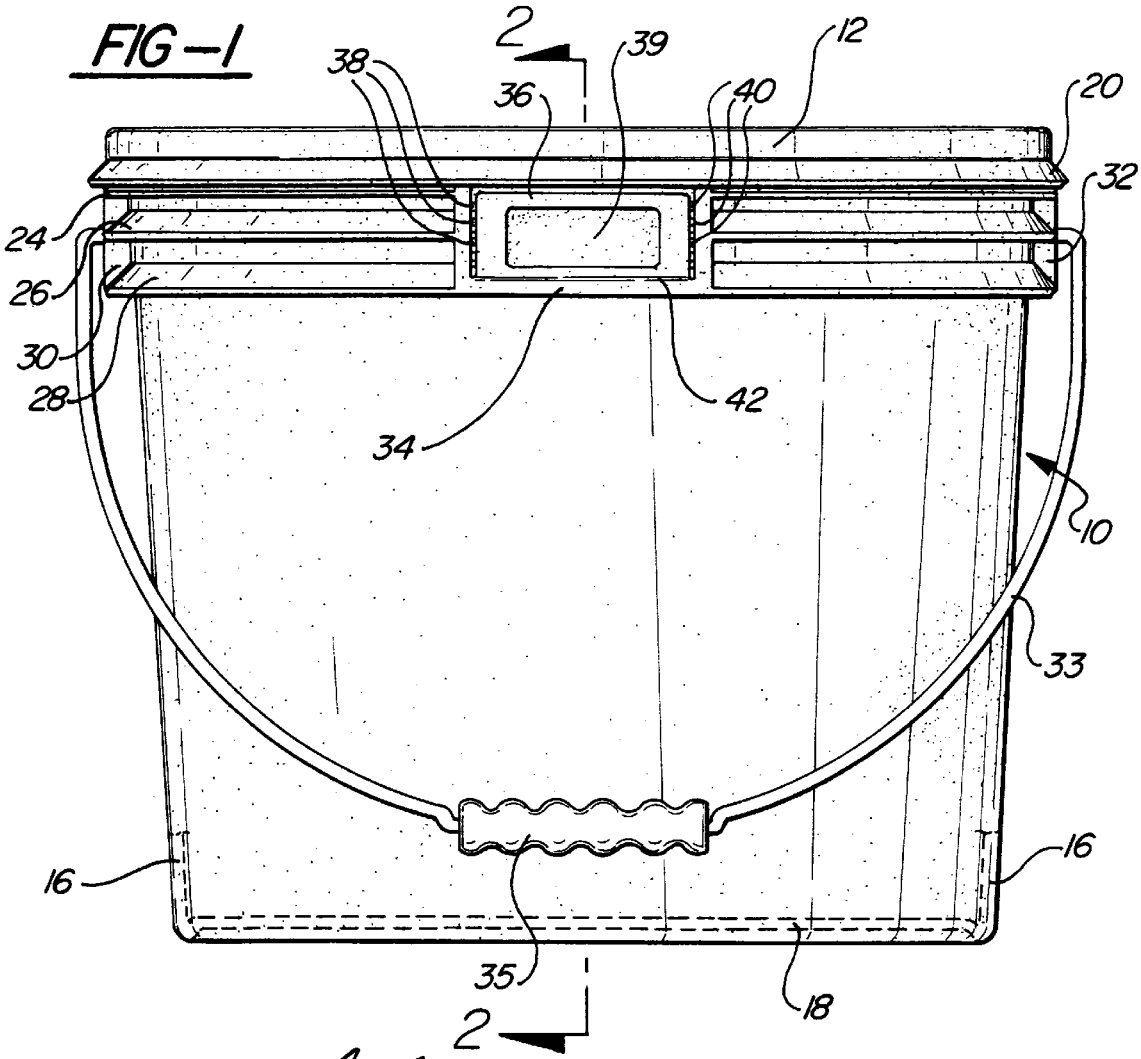
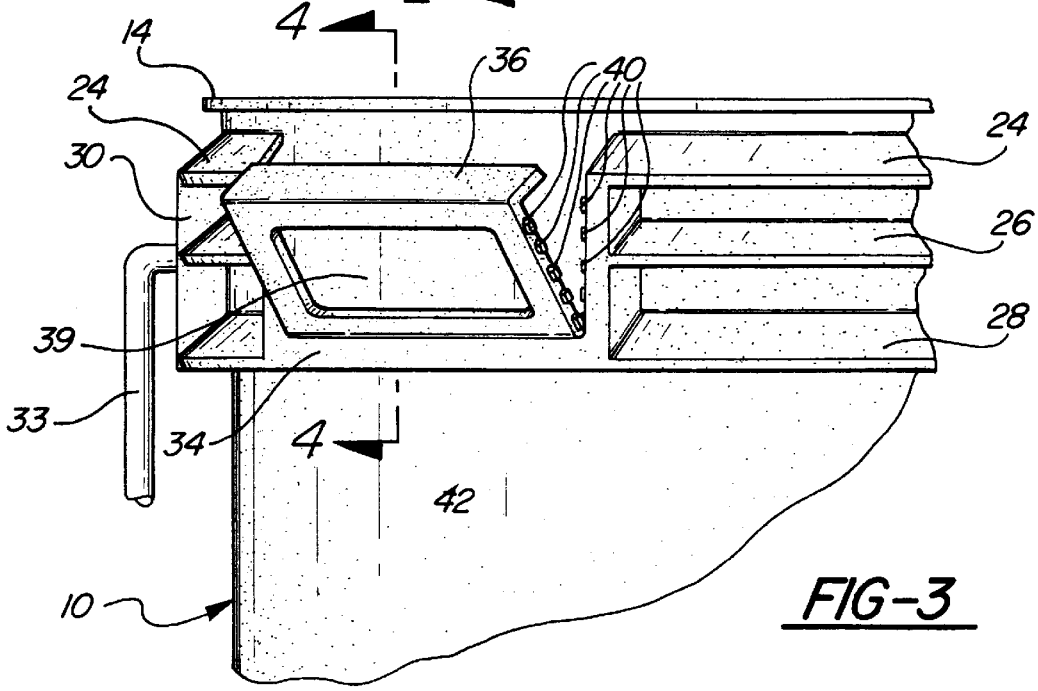
FIG-3

FIG-4
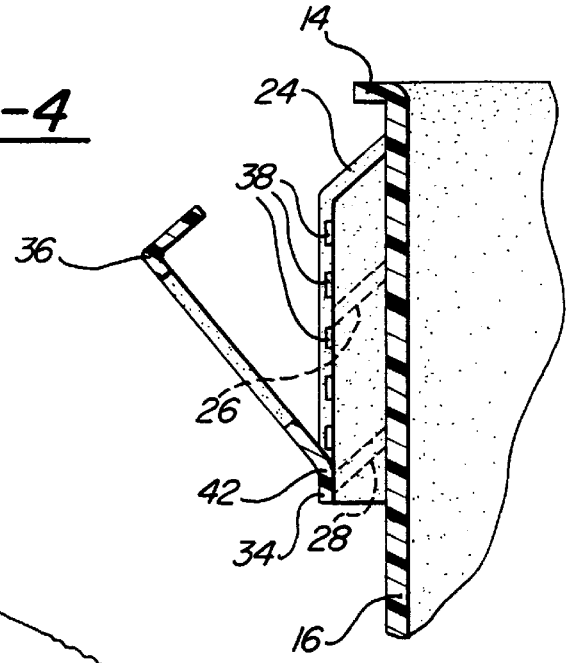
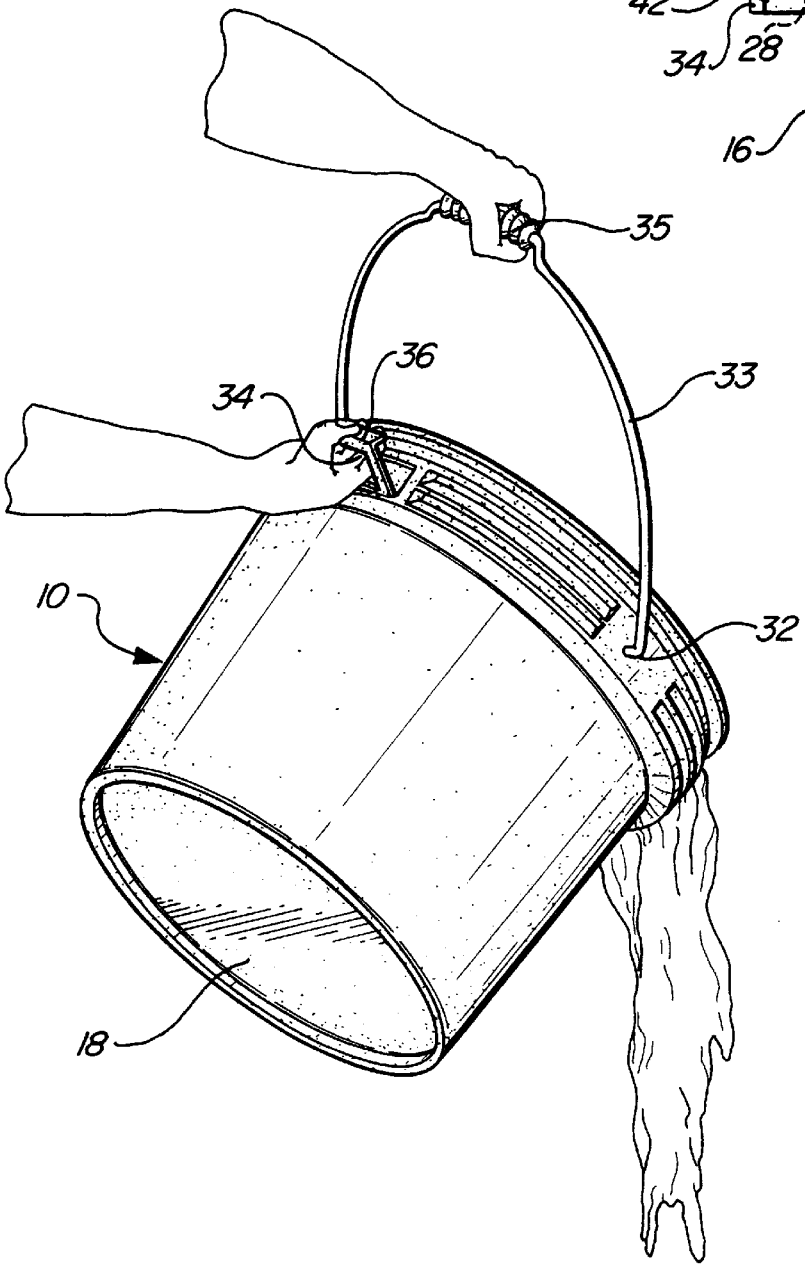
FIG-5

TAMPER EVIDENT PAIL AND CLOSURE

FIELD OF THE INVENTION

The invention lies in the design and structure of a pail adapted to receive a lid, commonly called a "closure", which provides evidence of tampering in that a frangible portion of the pail sidewall must be partly separated from the pail to provide manual lifting access to the closure. Both pail and closure are preferably molded plastic. The frangible portion thereafter can function as a lifting handle.

BACKGROUND OF THE INVENTION

It is now common to provide pails, bottles and other containers for various goods with structure which inhibits access to the interior of the container so as to provide physical evidence of tampering or entry prior to that of the end user. One approach is to provide a frangible skirt structure on the closure which, when broken in several places, reduces the hoop strength of the closure skirt sufficiently to permit the closure to be lifted and removed from the container. This approach tends to reduce the effectiveness of the closure in subsequent use.

Another approach which does not significantly affect the post-opening operability of the closure is to provide a tear strip on the pail or the closure which is located so as to prevent or inhibit removal of the closure until such time as the tear strip is removed. This poses the disadvantage of (a) adding significant structure to the pail which has no function at all after its initial operation and (b) generating refuse elements which, because they become totally separated from the container package, pose a risk of making their way into the container before the contents are removed.

SUMMARY OF THE INVENTION

A primary objective of the invention disclosed herein is to provide an improved structure which provides physical evidence of premature and/or unauthorized entry to a closed container but which does not reduce the effectiveness of the closure and does not generate refuse elements which are fully separated from the container after the operation. A second objective is to provide a tamper evident feature of the type described above wherein a break away element provides a significant function after it has been partially removed from the container structure to afford manual removal access to the closure.

In general, these objectives are accomplished through the provision of a molded plastic pail and closure combination of the type in which the closure mates with and effectively seals the upper open end of the container and wherein the closure includes a depending skirt portion to which manual access must be gained in order to manually remove the closure from the container. In the preferred embodiment the container includes an exterior ring structure which is integral with the container side wall so as to immediately underlie and limit manual access to the skirt portion of the closure when the closure is in sealing engagement with the top of the container. A break out portion integral with the rib structure is partially frangibly attached to the pail and partially permanently attached to the pail so that it may be broken out of the rib structure and hinged away from the underlying relationship with the skirt thereby to afford manual lifting access to the underside of the closure skirt. In the preferred form the breakout panel is located midway between bail attachment points and is configured in such a way as to operate as a handle to thereafter facilitate the process of lifting and/or pouring from the container; i.e., the break out panel remains permanently attached to the pail structure and provides a useful function during the remaining useful life of the pail.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 1 is a side view of a pail and closure combination embodying the invention;

FIG. 3 is a perspective view of the pail alone with the break out section partially removed from the pail;

FIG. 4 is a sectional view of the FIG. 3 detail; and

FIG. 5 is a perspective drawing showing how the breakout panel can be used as a pouring handle.

DETAILED DESCRIPTION OF THE ILLUSTRATIVE EMBODIMENT

Figure 2:
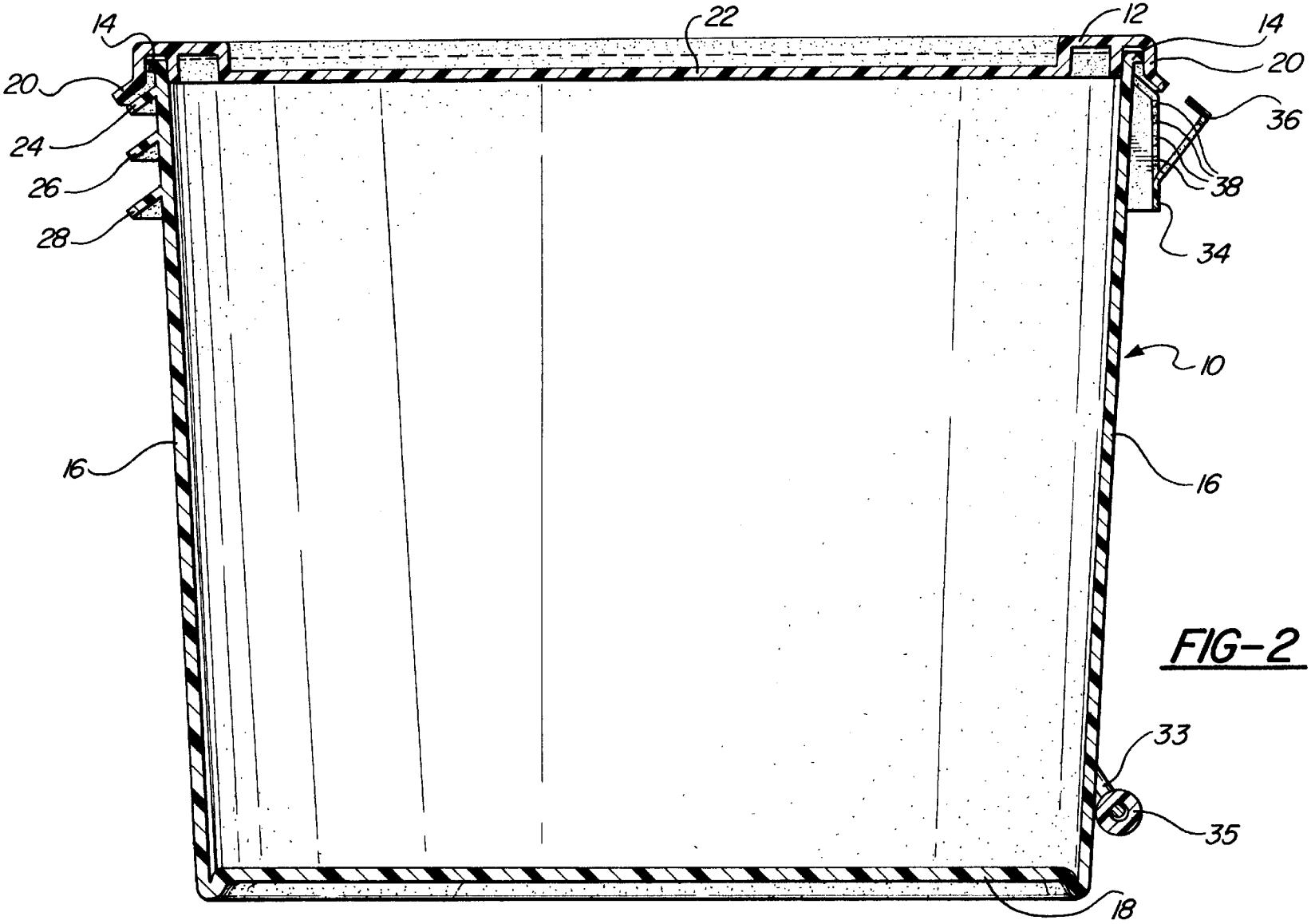
FIG. 2 is a side view in section of the upper portion of the pail and closure combination of FIG. 1 with the break out panel partly removed from the pail structure.

Referring to the drawing there is shown an injection molded, plastic pail 10 in combination with an injection molded, plastic closure 12 the construction of which is such that the closure may be snap-locked onto and in sealing engagement with a circular bead or rim 14 which is found at the open top of the pail 10. Both the pail 10 and closure 12 are preferably made from high-density polyethylene but other organic materials may be used. The pail 10 comprises a tapering cylindrical side wall 16 and a relatively flat but slightly recessed bottom panel 18. The interior of the pail 10 provides a smooth sanitary surface suitable for receiving and holding a wide variety of goods ranging from food products to sealants and/or adhesives. The pail 10 and closure 12 may be manufactured in various sizes, the range of 1 to 6 gallons being fairly typical.

The closure 12 exhibits a downwardly and outwardly flared peripheral skirt 20 which terminates in a bottom plane which, when the closure 12 is on the pail 10, it is parallel to the top plane of the pail and spaced below it by approximately ¾ of an inch. The preferred closure design is one which provides a slightly recessed top panel 22; the closure 12 may or may not include a sealing gasket in the inverted U-shaped channel between the outer skirt 20 and the interior panel 22. As will be appreciated by those skilled in and familiar with the industrial pail/closure construction technology, the closure snaps onto and effectively locks over the rim 14 with sufficient tenacity that substantial force, usually applied manually to the bottom of the skirt 20, is required to lift and remove the closure 12 from the pail 10.

The pail 10 is provided with a reinforcing ring structure consisting of spaced parallel circumferential reinforcing rings 24, 26 and 28. All of the rings 24, 26 and 28 are molded integrally with the side wall 16 of the pail 10 and adjacent but in spaced relationship with the upper rim 14 such that the upper most ring 24 immediately underlies and blocks manual access to the underside of the skirt 20 so as to inhibit or prevent removal of the closure 12 from the pail 10.

Integral with the ring structure are bail ears 30 and 32 located at opposite; i.e., 180° spaced, locations about the pail sidewall 16. As best shown in FIGS. 3 and 5, the bail ears 30 and 32 are configured in such a way as to receive and provide a pivotal relationship with a wire bail 33 having a handle portion 35 which facilitates lifting of the pail 10 both with and without the closure 12.

At least approximately midway between the bail ears 30 and 32 and structured as an interruption in the reinforcing ring structure, the pail 10 is provided with a three sided rectangular frame 34 partially surrounding and partially integral with a rectangular break out panel 36 the side edges of which are frangibly interconnected with the adjacent frame sections by thin, discontinuous webs 38 and 40 which are relatively easily broken by manual pressure at the appropriate time as hereinafter described. The entire bottom edge of the break out panel 36 is, however, permanently and integrally attached to the adjacent frame 34 by way of an integral or "living" hinge 42 which permits the rectangular break out panel 36, when the frangible webs 38 and 40 are fractured, to pivot outwardly and downwardly away from the pail sidewall 16 in the manner shown in FIG. 3.

As best shown in FIGS. 1 and 2 the break out panel 36 and particularly the top horizontal portion thereof represents a removable continuation of the reinforcing ring structure which immediately underlies the skirt 20 of the closure when in the sealed arrangement shown in FIG. 1. Whereas the top ring 24 inhibits or prevents access to the underside of the skirt 20 for approximately 340° of angular extension, the break away panel 36 completes the access limiting feature for the remaining circumferencial extent when it is held in place by the frangible web portions 38 and 40 as shown in FIGS. 1 and 2.

As best shown in FIG. 2 the break away panel 36 is L-shaped in side section and is spaced from the pail sidewall by one-half inch or more so as to permit a person's fingertips to fit through rectangular opening 39 to pull the panel 36 away from the pail and fracture areas 38 and 40. As best shown in FIG. 1, the central rectangular opening 39, together with shell like structure of the break away panel 36 permits the panel to be operated in the fashion of a handle; i.e., it is possible for one to insert the ends of three or even four fingers through the opening 39 and to engage the inside surface of the top horizontal portion of the break away panel to provide leverage to pull it away from the side wall structure 16 and fracture the webs 38 and 40. The break away panel 36 then assumes the orientation shown in FIG. 3.

In this orientation there exists a discontinuity in the upper most ring 24 which discontinuity affords manual access to the underside of the skirt 20 and permits the closure 12 to be removed from the container. It will be appreciated that this is achieved without damage or alteration of any kind to the closure itself. Thus the closure 10 retains its sealing qualities throughout the period in which it is associated with the pail 10 and may be removed and replaced as often as is desired or necessary. The break away panel 36, because it is permanently attached to the side wall structure of the pail 10 along the living hinge 42, does not become an element of refuse and cannot find its way into the interior of the pail. To the contrary, the break away panel 36, because of its physical configuration and its pivotal attachment to the pail 10 approximately midway between the bail ears 30 and 32, provides a convenient lifting point to facilitate pouring the contents of the pail 10 as shown in FIG. 5.

It will be apparent to those skilled in the appropriate arts and technologies that various modifications and design changes to the illustrative embodiment described above may be made while retaining and continuing to enjoy the benefits of the invention disclosed herein.

What is claimed is:

1. An open top, molded plastic pail for use in combination with a snap-on closure of the type having a peripheral skirt comprising:

an essentially cylindrical sidewall;

a bottom;

a peripheral ring structure on and integral with the sidewall and extending outwardly therefrom in adjacent, spaced parallel relationship to the top of the pail so as to immediately underlie and limit manual access to the closure skirt when in place on the pail; and a break out panel integral with the pail sidewall and having at least a first portion which is frangibly attached to the pail and a second portion which is permanently but hingedly attached to the pail so as to be partially separable from the pail wall and pivotally displaced away from the underlying relationship with the closure skirt to afford access to a portion of the closure skirt for removal purposes, the break out panel also having a central opening so that it may be operated as a handle.

2. A pail as defined in claim 1 wherein the peripheral ring structure comprises at least first and second spaced parallel rings extending at least substantially continuously around the pail sidewall adjacent but in spaced relationship with the top of the pail, at least a portion of the break out panel being so disposed as to form a continuation of the uppermost ring in said peripheral ring structure before it is separated from the pail sidewall.

3. A pail as defined in claim 1 further including bail ears integrally molded with said peripheral ring structure and located at opposite locations about said pail sidewall; said break out panel being at least essentially midway between said bail ears.

4. A pail as defined in claim 3 further including a bail attached between said bail ears.

5. An open top, molded plastic pail in combination with a snap-on closure having a skirt, said pail comprising:

an essentially cylindrical sidewall, a bottom, a peripheral ring structure on and integral with the sidewall and extending outwardly therefrom in adjacent, spaced parallel relationship to the top of the pail so as to immediately underlie and limit manual access to the closure skirt on the pail, a break out panel integral with the pail sidewall and having at least a first portion which is frangibly attached to the pail and a second portion which is permanently but hingedly attached to the pail so as to be partially separable from the pail sidewall and pivotally displaced away from the underlying relationship with the closure skirt to afford access to a portion of the closure skirt for removal of the closure, the break out panel also having a central opening so that it may be operated as a handle, and said closure having a top panel for sealing engagement with the top of the pail and said skirt being flared and extending circumferentially around said top panel.

6. A method of operating a container of the type having an open top, a continuous sidewall, a bottom and a snap on skirted closure covering said open top comprising the steps of:

partially fracturing a break-out panel from the sidewall of the pail, pivoting the break-out panel outwardly from a portion immediately underlying the closure skirt, removing the closure from the pail by lifting the portion of the skirt exposed by the break-out panel, and grasping the break-out panel and lifting the pail to pour out the contents thereof.

* * * * *